US009504316B1

(12) United States Patent
Streicher et al.

(10) Patent No.: US 9,504,316 B1
(45) Date of Patent: Nov. 29, 2016

(54) HEIGHT ADJUSTABLE DESKTOP ASSEMBLY

(71) Applicants: Henry Streicher, Brooklyn, NY (US); Huaijie Ma, Brooklyn, NY (US)

(72) Inventors: Henry Streicher, Brooklyn, NY (US); Huaijie Ma, Brooklyn, NY (US)

( * ) Notice: Subject to any disclaimer, the term of this patent is extended or adjusted under 35 U.S.C. 154(b) by 0 days.

(21) Appl. No.: 15/133,650

(22) Filed: Apr. 20, 2016

(51) Int. Cl.

| | |
|---|---|
| ***A47B 9/00*** | (2006.01) |
| ***A47B 21/02*** | (2006.01) |
| ***A47B 9/16*** | (2006.01) |
| ***A47B 9/10*** | (2006.01) |
| ***A47B 9/14*** | (2006.01) |
| ***A47B 21/04*** | (2006.01) |

(52) U.S. Cl.
CPC ..... *A47B 21/02* (2013.01); *A47B 9/10* (2013.01); *A47B 9/14* (2013.01); *A47B 9/16* (2013.01); *A47B 21/04* (2013.01)

(58) Field of Classification Search
CPC ..... A47B 9/16; A47B 9/00; A47B 9/10
USPC ..... 108/145, 147, 50.01, 50.02, 147.11, 108/106; 248/164, 166; 254/122, 124, 9 C, 254/10 C
See application file for complete search history.

(56) References Cited

U.S. PATENT DOCUMENTS

| | | | | | |
|---|---|---|---|---|---|
| 226,053 | A * | 3/1880 | Finnegan | A47B 21/0314 | 108/138 |
| 4,403,680 | A * | 9/1983 | Hillesheimer | B66F 7/065 | 177/146 |
| 4,515,086 | A * | 5/1985 | Kwiecinski | A47B 21/0314 | 108/104 |
| 4,926,760 | A * | 5/1990 | Sack | B66F 7/0666 | 108/145 |
| 5,632,209 | A * | 5/1997 | Sakakibara | A47B 9/02 | 108/145 |
| 5,829,948 | A * | 11/1998 | Becklund | B66F 7/0625 | 187/237 |
| 6,038,986 | A * | 3/2000 | Ransil | A47B 9/02 | 108/145 |
| 6,112,858 | A * | 9/2000 | Arnst | B66F 7/0625 | 104/44 |
| 6,286,812 | B1 * | 9/2001 | Cherry | B66F 7/065 | 254/122 |
| 6,397,763 | B1 * | 6/2002 | Panzarella | A47B 21/0314 | 108/138 |
| 6,585,214 | B1 * | 7/2003 | Dittmer | F16M 11/38 | 248/370 |
| 6,679,479 | B1 * | 1/2004 | Watkins | B66F 7/08 | 254/122 |
| 6,705,238 | B1 * | 3/2004 | Heckert | B66F 7/065 | 108/145 |
| 6,857,493 | B2 * | 2/2005 | Shupp | B60T 7/16 | 180/168 |
| 7,677,518 | B2 * | 3/2010 | Chouinard | A47B 21/02 | 108/10 |
| 7,950,338 | B2 * | 5/2011 | Smed | A47B 9/16 | 108/119 |
| 8,015,638 | B2 * | 9/2011 | Shimada | A47C 19/04 | 108/145 |
| 8,424,883 | B1 * | 4/2013 | Ramos | B62B 3/02 | 108/145 |
| 8,469,152 | B2 * | 6/2013 | Olsen | B66F 7/065 | 187/211 |
| 9,055,810 | B2 * | 6/2015 | Flaherty | A47B 9/18 | |
| 9,133,976 | B2 * | 9/2015 | Lin | F16M 11/24 | |
| 2004/0040480 | A1 * | 3/2004 | Hwang | A47B 3/02 | 108/145 |

(Continued)

*Primary Examiner* — Jose V Chen
(74) *Attorney, Agent, or Firm* — Ezra Sutton

(57) ABSTRACT

The present disclosure provides a desktop assembly and height adjustment frame mechanism that facilitates height adjustment of a desktop. The desktop assembly and height frame adjustment mechanism includes a desktop assembly having upper and lower platform surfaces; and a frame adjustment mechanism for adjustably supporting the desktop assembly. The frame adjustment mechanism further includes: an upper support frame, including a left upper bracket and a right upper bracket; a base support frame, including a left lower bracket and a right lower bracket; an X-shaped support frame that pivotally connects the upper support frame and the base support frame, wherein the X-shaped support frame further includes a pair of left and right first pivot legs pivotally interconnected at the center to a pair of left and right second pivot legs; a pair of hydraulic cylinders which facilitate raising and lowering the upper and lower platform surfaces; and a pair of locking levers pivotally attached to the upper platform.

8 Claims, 9 Drawing Sheets

(56) References Cited

U.S. PATENT DOCUMENTS

2007/0034125 A1* 2/2007 Lo ..... B66F 7/0608 108/145

2013/0145972 A1* 6/2013 Knox ..... B60N 3/063 108/145

2015/0289641 A1* 10/2015 Ergun ..... A47B 9/16 108/42

* cited by examiner

HEIGHT ADJUSTABLE DESKTOP ASSEMBLY

FIELD OF THE INVENTION

The present invention relates to a desktop assembly and height adjustment frame mechanism. The height adjustment X-frame mechanism selectively adjusts the height of the desk assembly to facilitate a user using one or more platform surfaces of the desk assembly while either standing or sitting.

BACKGROUND OF THE INVENTION

Conventional computer stands support the keyboard and monitor at a level intended for use by an operator that are sitting in a chair. However, because the operator is required to sit to operate the computer, the operator's range of movement is limited in that it prevents the operator from working in a standing position and to exercise his legs or back while operating the computer.

In addition, studies have invariably shown that office workers who sit at their desks all day could be harmful to their health. Specifically, prolonged sitting has been linked to high blood pressure and elevated cholesterol, and people with the most sedentary time are more than twice as likely to have cardiovascular disease. In addition, studies have linked sitting to a greater risk for colon, breast and endometrial cancers. In addition, studies have further suggested that hunching over a computer is a leading reason why people end up with crippling back pain at some point in their lives.

Therefore, in order to alleviate the health concerns associated with sedentary office workers, there is a need for a desktop assembly that includes a height adjustment frame mechanism that selectively adjusts the height of the desk assembly to facilitate a computer operator using one or more platform surfaces of the desk assembly while either standing or sitting.

Although adjustable desktops exist, the present invention provides an improved structure and features that make it sturdy, user friendly, and provide it with other advantages discussed below.

DESCRIPTION OF THE PRIOR ART

Prior art U.S. Pat. No. 7,677,518 to Chouinard, et al. and U.S. Pat. No. 9,161,616 to Arishenkoff, et al.; and U.S. Patent Application Publication Nos. 2014/0144352 to Roberts and 2014/0360411 to Hatter all disclose adjustable desks with various structures.

In particular, Varidesk, LLC owns prior art U.S. Pat. Nos. 8,671,853; 9,005,810; and U.S. Pat. No. 9,113,703 to Flaherty and U.S. Pat. No. 9,277,809 to Flaherty, et al, which all disclose an adjustable desk platform including an upper platform and a lower platform and a locking mechanism. However, all of these patents disclose a set of parallel arms, instead of a double "X-frame," that connects the lower platform and the upper platform. These parallel arms are adapted to move the upper platform substantially in parallel with the lower platform between a fully raised position and a fully lowered position.

However, none of the aforementioned prior art patents teach or disclose a desktop assembly and height adjustment frame mechanism that facilitates height adjustment of a desktop by providing a desktop assembly having upper and lower platform surfaces, an X-shaped support frame that provides enhanced rigidity while pivotally connecting the upper support frame and the base support frame for vertically moving the desktop about a perpendicular axis (Y) relative to the base support frame; a pair of hydraulic cylinders which facilitates raising and lowering the upper and lower platform surfaces; and a pair of locking levers pivotally attached to the upper platform.

OBJECTS OF THE INVENTION

It is an object of the present invention to provide a desktop assembly and height adjustment frame mechanism that can ergonomically and efficiently adjust the height of a desktop workstation.

Another object of the present invention is to provide a desktop assembly and height adjustment frame mechanism that is portable and can ergonomically and efficiently adjust the height of a computer monitor and input device so that a user can operate a computer and input device while seated or while standing.

Another object of the present invention is to provide a desktop assembly and height adjustment frame mechanism that uses a double "X-frame" adjustment mechanism to connect the desktop assembly to the base support. The double "X-frame" configuration of the adjustment mechanism improve frame strength without adversely affecting the foldability of the frame.

SUMMARY OF THE INVENTION

The present invention provides a desktop assembly and height adjustment frame mechanism that facilitates height adjustment of a desktop. The desktop assembly and height frame adjustment mechanism includes a desktop assembly having upper and lower platform surfaces; and a frame adjustment mechanism for adjustably supporting the desktop assembly. The frame adjustment mechanism further includes: an upper support frame, including a left upper bracket and a right upper bracket; a base support frame, including a left lower bracket and a right lower bracket; an X-shaped support frame that pivotally connects the upper support frame and the base support frame, wherein the X-shaped support frame further includes a pair of left and right first pivot legs pivotally interconnected at the center to a pair of left and right second pivot legs; a pair of hydraulic cylinders which facilitate raising and lowering the upper and lower platform surfaces; and a pair of locking levers pivotally attached to the upper platform.

DETAILED DESCRIPTION OF THE PREFERRED EMBODIMENT

Figure 1:
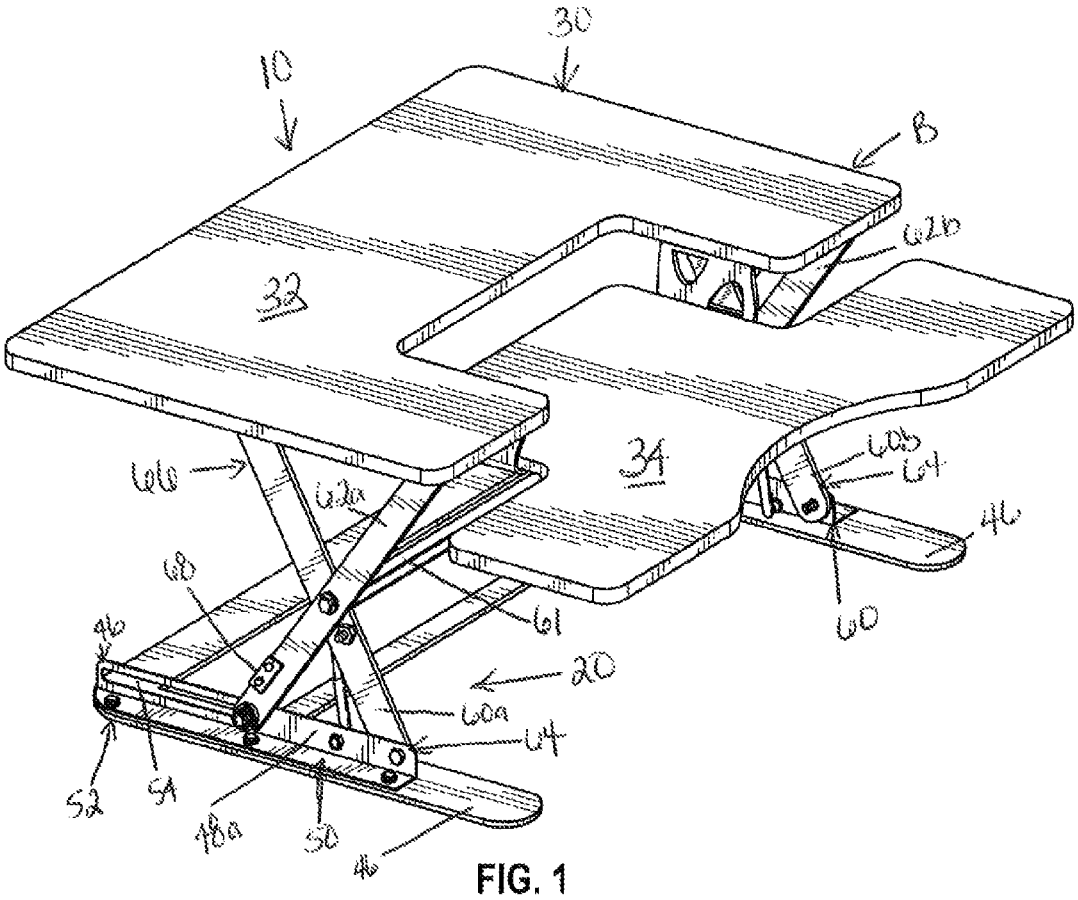
FIG. 1 is a perspective view of a desktop assembly in a raised position.
Figure 2:
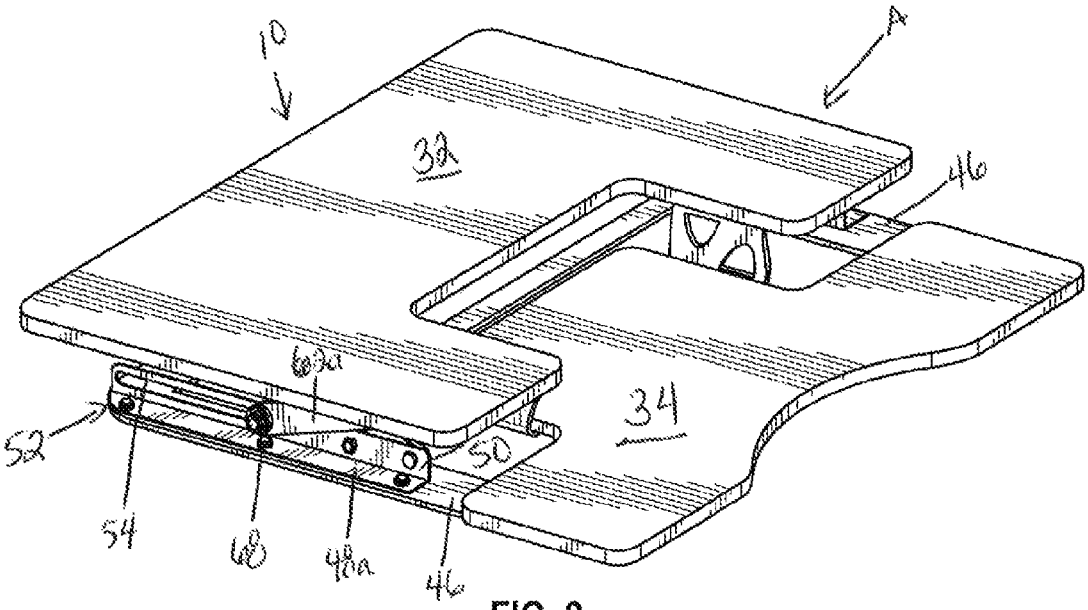
FIG. 2 is a perspective view of a desktop assembly in a lowered position.
Figure 3:
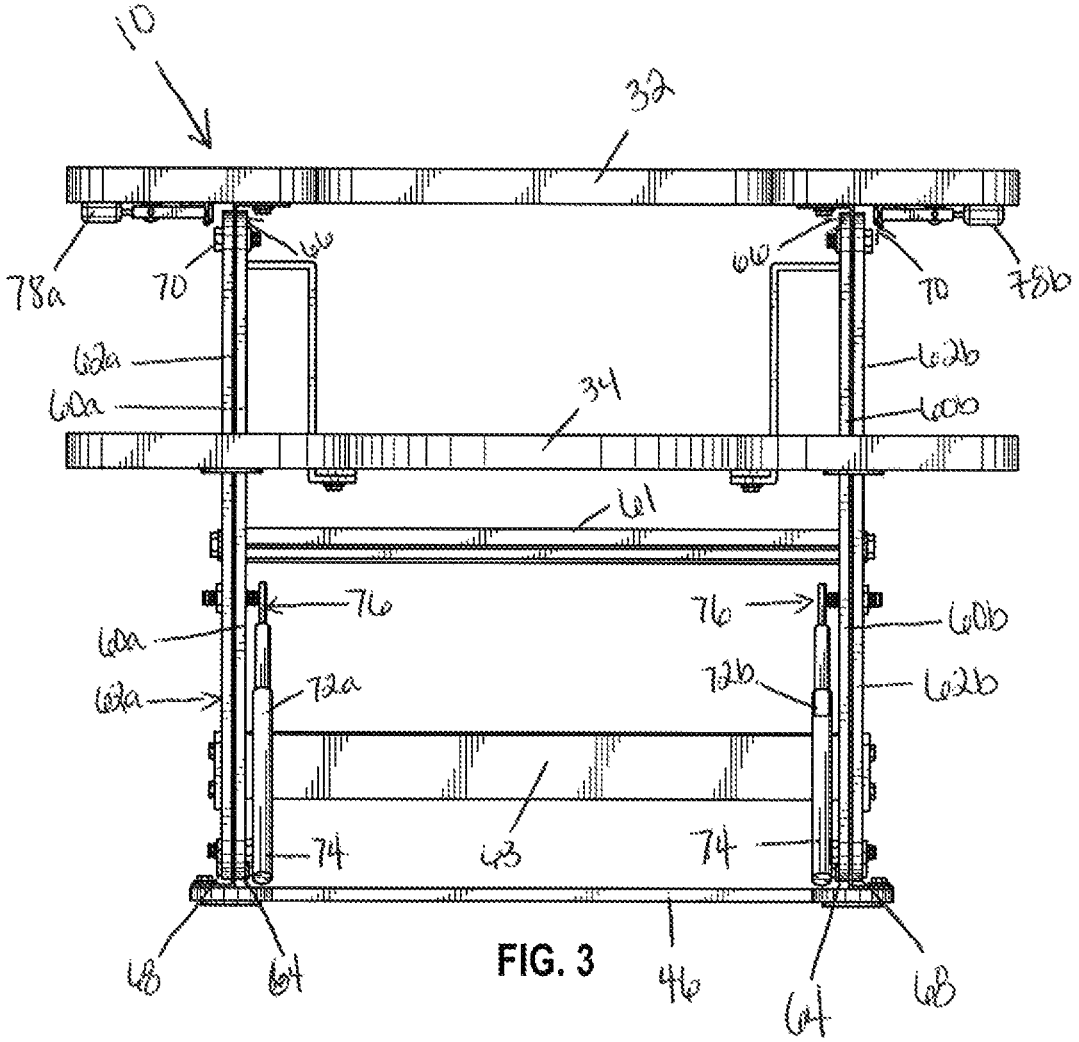
FIG. 3 is a front view of the desktop assembly of FIG. 1.
Figure 4:
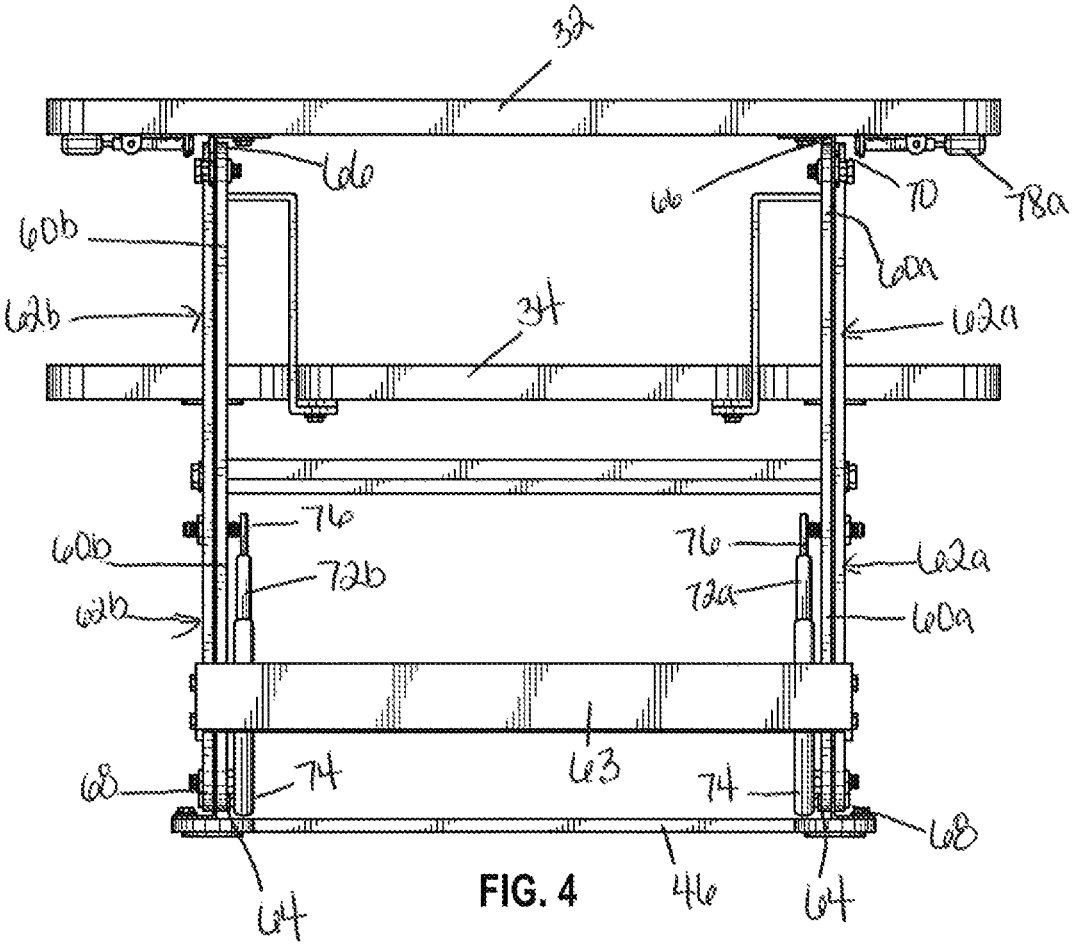
FIG. 4 is a rear view of the desktop assembly.
Figure 5:
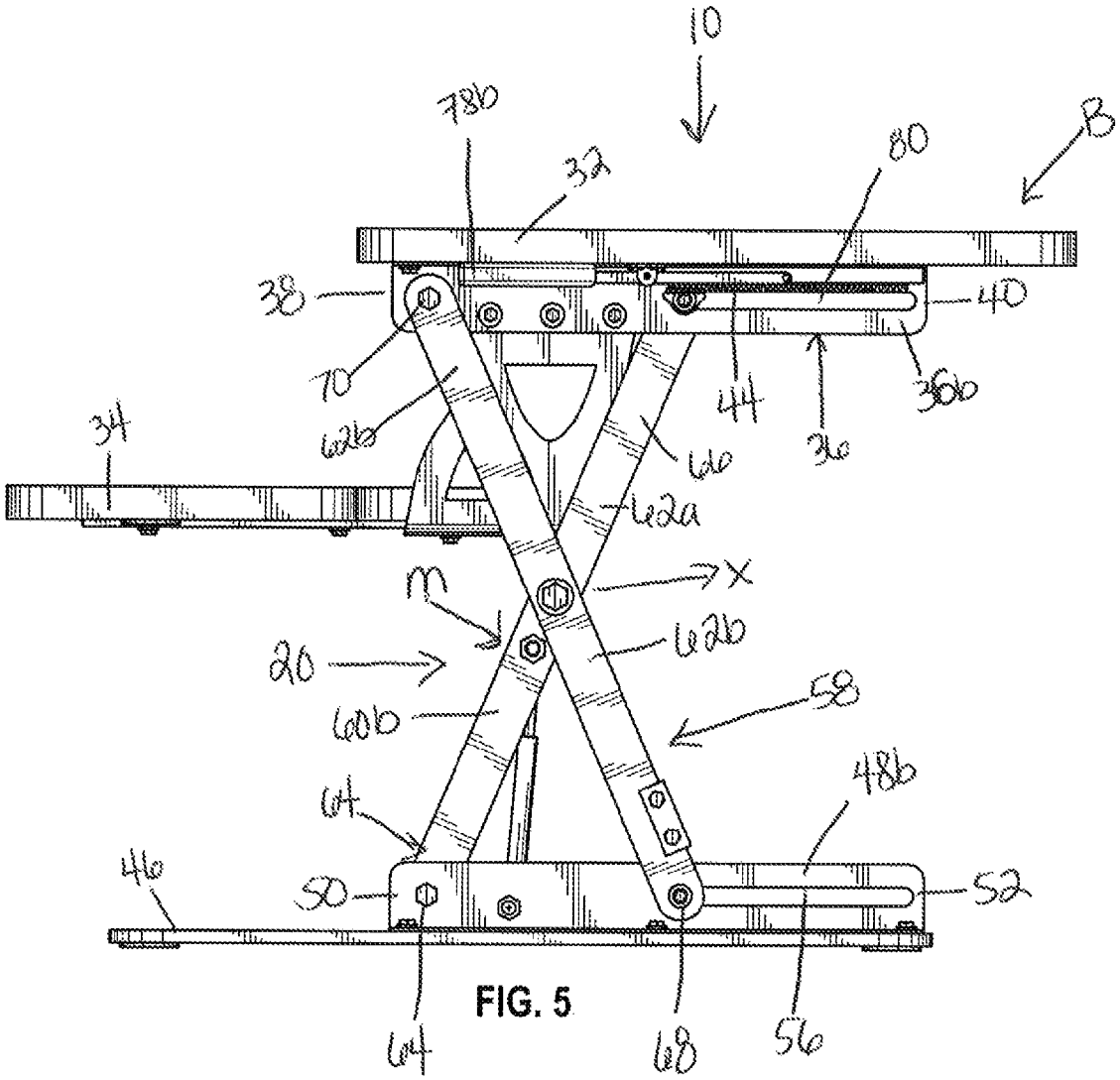
FIG. 5 is a right side view of the desktop assembly.
Figure 6:
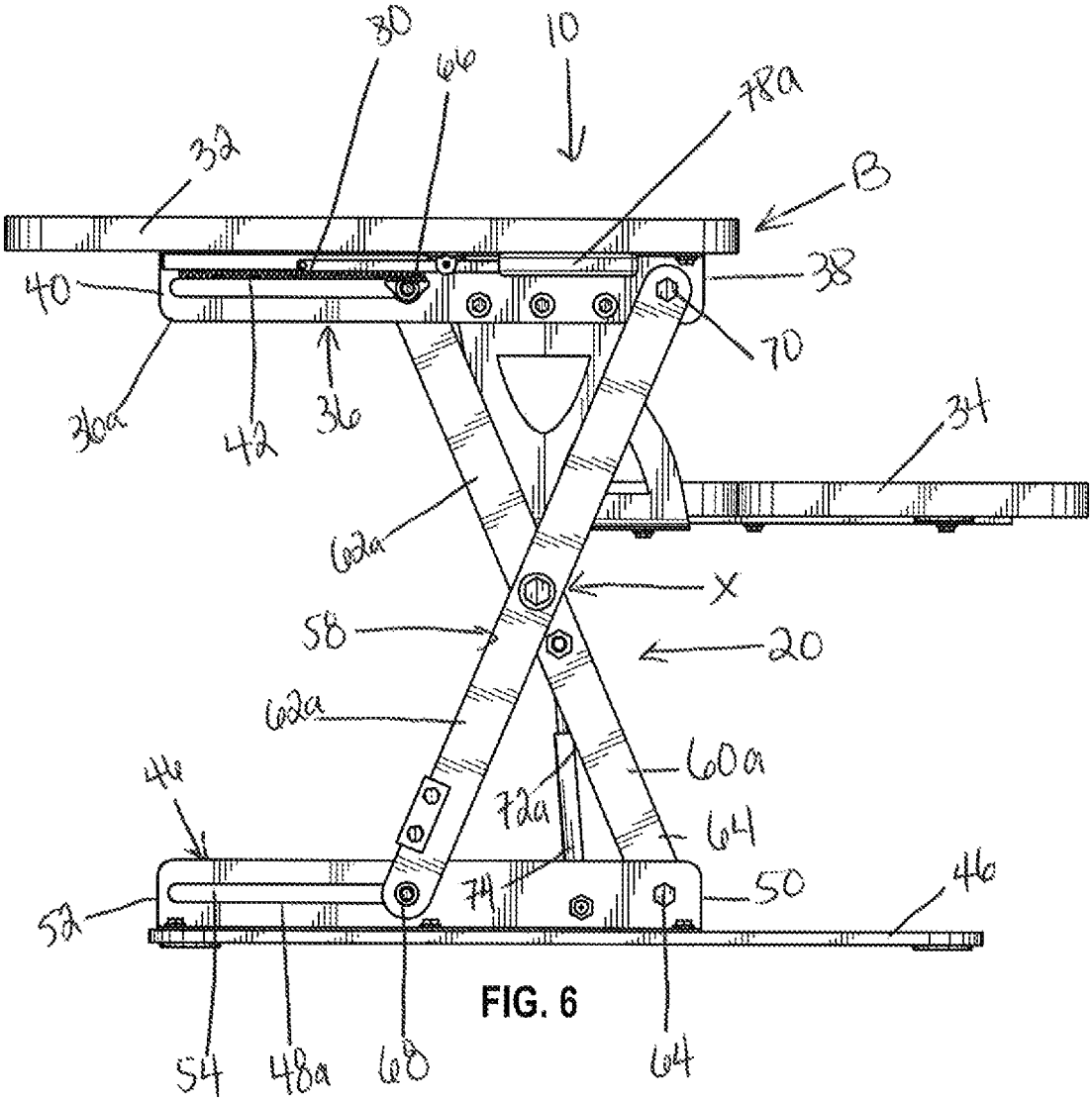
FIG. 6 is a left side view of the desktop assembly.
Figure 7:
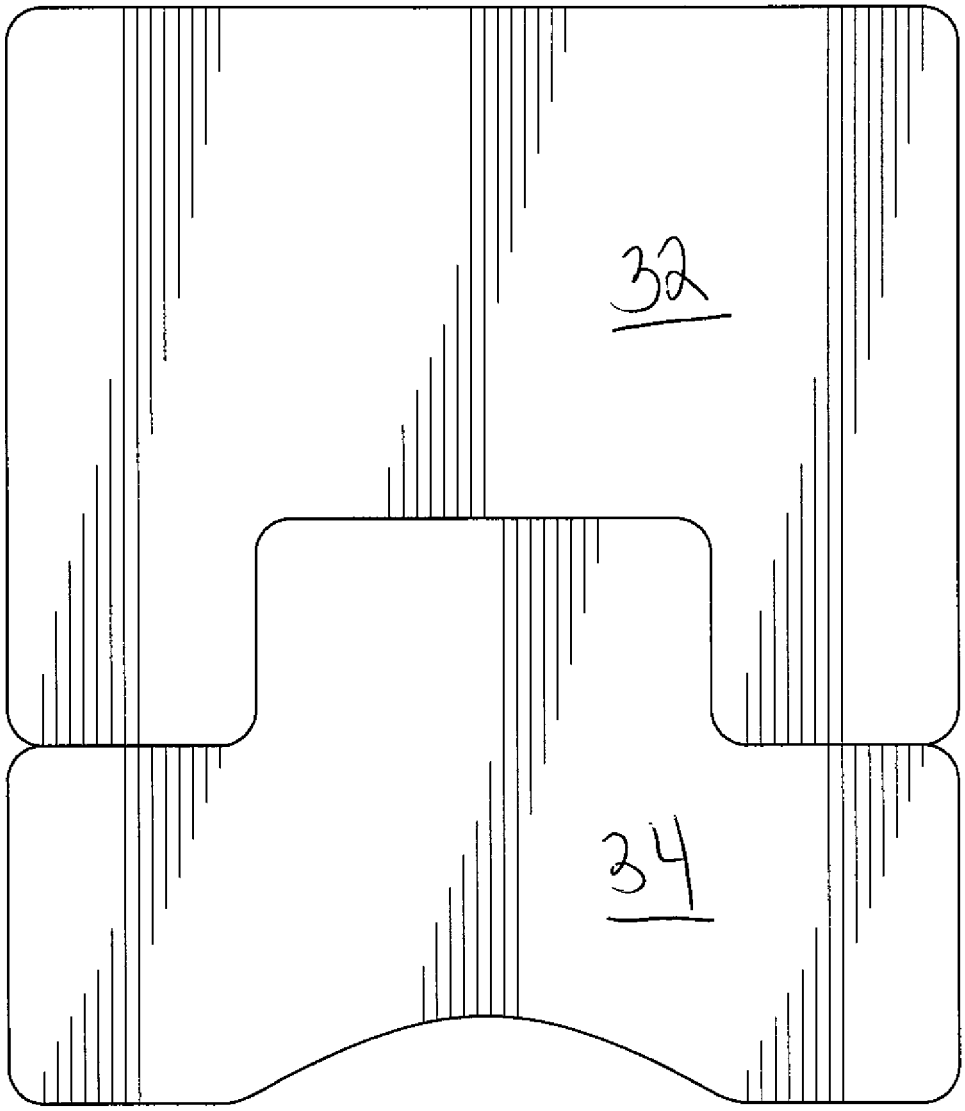
FIG. 7 is a top plan view of the desktop assembly.
Figure 8:
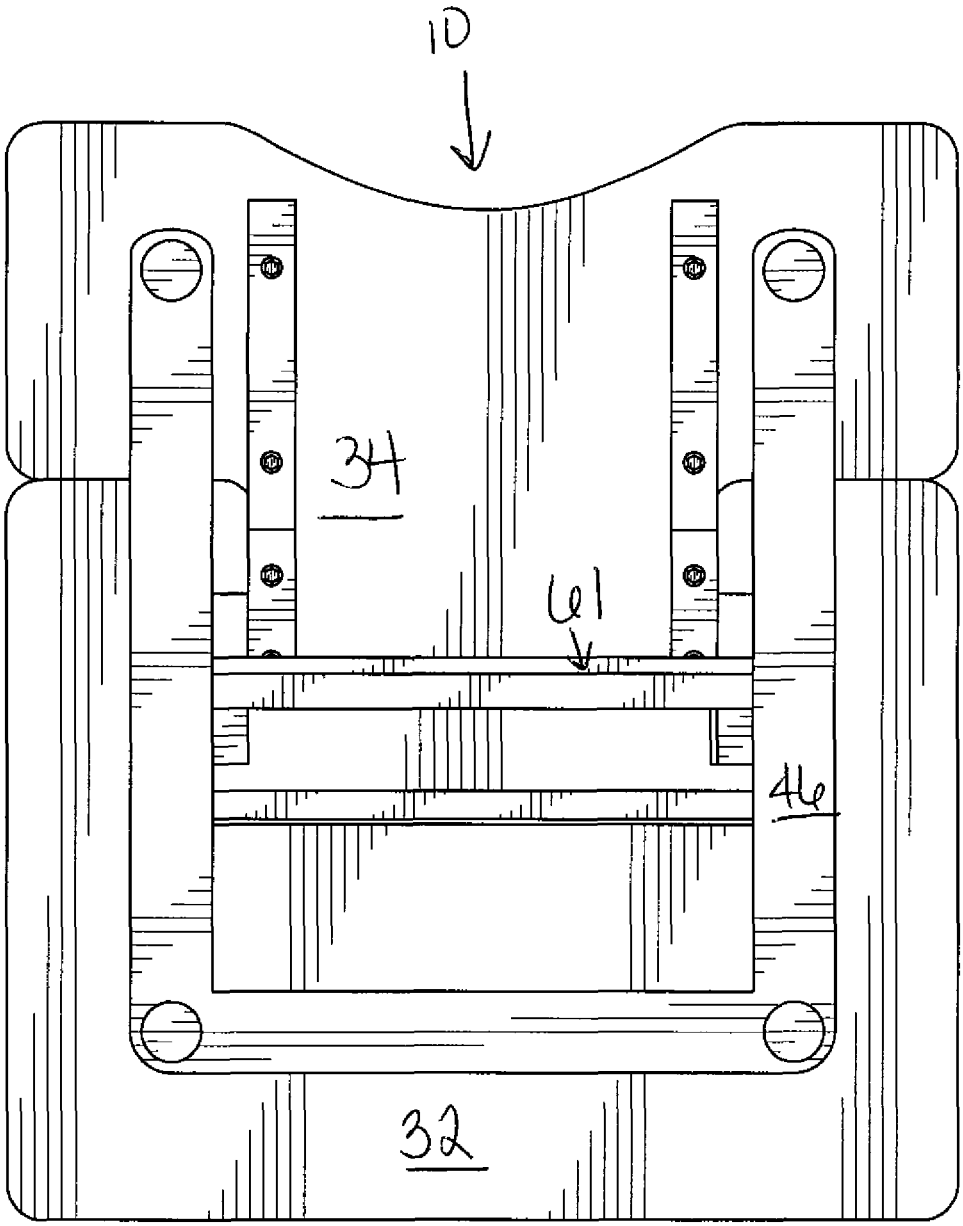
FIG. 8 is a bottom plan view of the desktop assembly.
Figure 9:
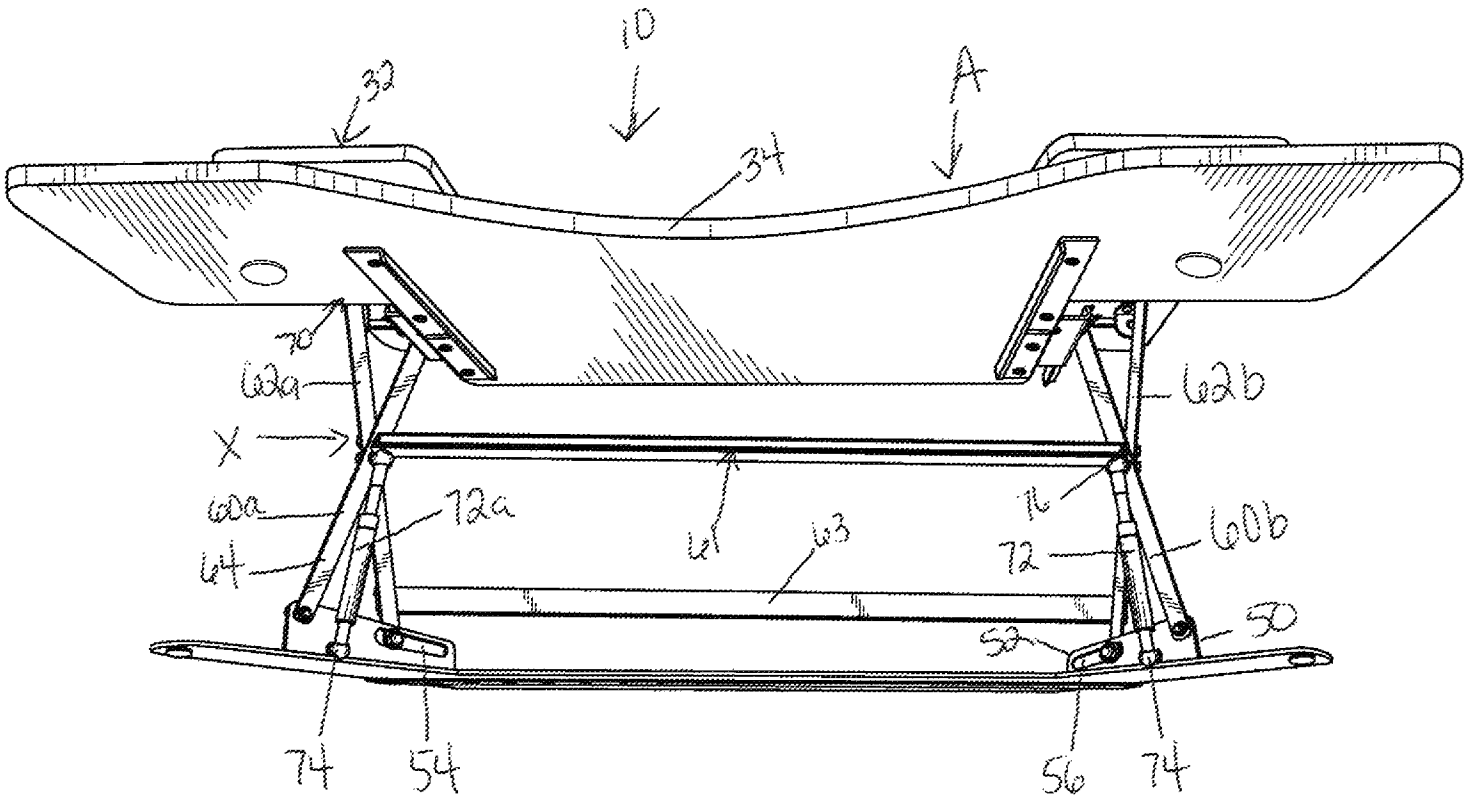
FIG. 9 is a front view of the underside frame assembly of the desktop assembly.

The present invention, as shown in FIGS. 1 and 2, provides a desktop assembly 10 and height adjustment frame mechanism 20 that facilitates height adjustment of a desktop. The desktop assembly 10 and height frame adjustment mechanism 20 includes a desktop 30 having upper and lower platform surfaces 32 and 34; and wherein a frame adjustment mechanism 20 adjustably supports the desktop 10.

The upper and lower platform surfaces 32 and 34 are arranged at different heights with respect to each other. In addition, the main work platform 32 may be configured to support one or more monitors and the secondary work platform 34 may configured to support a keyboard and a computer input device. Also, the lower platform surface 34 may be adjustably attached to the upper platform surface 32 via, for example, one or more adjustable brackets, or any other suitable adjustable attachment means. Furthermore, the desktop assembly 10 may comprise a single platform configured to support one or more monitors and a keyboard instead of the upper and lower platform surfaces 32 and 34.

The frame adjustment mechanism 20 further includes an upper support frame 36 having a left upper bracket 36*a* and a right upper bracket 36*b*. Each of the left and right upper brackets 36*a* and 36*b* includes proximal and distal ends 38 and 40. Also, the left and right upper brackets 36*a* and 36*b* each contain horizontal channels 42 and 44 at their distal ends 40. Each of the left and right upper brackets 36*a* and 36*b* is fixedly attached to the underside of the upper platform surface 32 of the desktop 10.

The frame adjustment mechanism 20 further includes a base support frame 46, including a left lower bracket 48*a* and a right lower bracket 48*b*. Each of the left and right lower brackets 48*a* and 48*b* includes proximal and distal ends 50 and 52. Also, the left and right lower brackets 48*a* and 48*b* each contain horizontal channels 54 and 56 at their distal ends 52. Each of the left and right lower brackets 48*a* and 48*b* is fixedly attached to the topside of base support frame 46.

Furthermore, adjustment mechanism 20 includes an X-shaped support frame 58 that pivotally connects the upper support frame 36 and the base support frame 46. Thus, the adjustment mechanism 20 permits a user to selectively adjust the height of the upper and lower platform surfaces 32 and 34 of the desktop 10 by vertically moving the desktop 10 about a perpendicular axis (Y) relative to the base support frame 46. Specifically, the X-shaped support frame 58 includes a pair of left and right first pivot legs 60*a* and 60*b* pivotally interconnected at the center (X) to a pair of left and right second pivot legs 62*a* and 62*b*. Thus, this structure permits the user of the desktop assembly 10 to selectively adjust the height positions of the upper and lower platform surfaces 32 and 34 from a lowered position (A) to facilitate use of the desktop assembly by a user in a sitting position to a raised position (B) to facilitate use by a user in a standing position.

The first pivot legs 60*a* and 60*b* each have lower and upper ends 64 and 66. The lower ends 64 of the first pivot legs 60*a* and 60*b* are pivotally connected to the proximal ends 50 of each of the left and right lower brackets 48*a* and 48*b*. The upper ends 66 of the first pivot legs 60*a* and 60*b* are pivotally and slideably attached within the horizontal channels 42 and 44 of the distal ends 40 of the left and right upper brackets 36*a* and 36*b*. In addition, the pair of first pivot legs 60*a* and 60*b* may optionally be further connected to each other by one or more lateral stabilizing bars 61.

The second pivot legs 62*a* and 62*b* each have lower and upper ends 68 and 70. The upper ends 70 of the second pivot legs 62*a* and 62*b* are pivotally connected to the proximal ends 38 of each of the left and right upper brackets 36*a* and 36*b*. The lower ends 68 of the second pivot legs 62*a* and 62*b* are pivotally and slideably attached within the horizontal channels 54 and 56 of the left and right lower brackets 48*a* and 48*b*. In addition, the pair of second pivot legs 62*a* and 62*b* may optionally be further connected to each other by one or more lateral stabilizing bars 63.

In addition, adjustment mechanism 20 further includes a pair of hydraulic cylinders 72*a* and 72*b* which facilitate raising and lowering the upper and lower platform surfaces 32 and 34. Each hydraulic cylinder 72*a* and 72*b* has a lower end and an upper end 74 and 76. The lower end 74 of each hydraulic cylinder 72*a* and 72*b* is connected to the proximal ends 50 of each of said left and right lower brackets 48*a* and 48*b*. Also, the upper end 76 of each hydraulic cylinder 72*a* and 72*b* is attached to the middle portion (M) of each of said first pivot legs 60*a* and 60*b*.

Finally, adjustment mechanism 20 also comprises a pair of locking levers 78*a* and 78*b* for adjusting the height of the upper and lower platform 32 and 34 at the desired height. Each of the locking levers 78*a* and 78*b* is pivotally attached to the upper platform 32. Also, each locking lever 78*a* and 78*b* includes teeth 80 for mateably and adjustably engaging with the left and right upper brackets 36*a* and 36*b* for locking the upper and lower platform surfaces 32 and 34 at a desired height.

Advantages of the Present Invention

An advantage of the present invention is to provide a desktop assembly and height adjustment frame mechanism that can ergonomically and efficiently adjust the height of a desktop workstation.

Another advantage of the present invention is to provide a desktop assembly and height adjustment frame mechanism that is portable and can ergonomically and efficiently adjust the height of a computer monitor and input device so that a user can operate a computer and input device while seated or while standing.

Another advantage of the present invention is to provide a desktop assembly and height adjustment frame mechanism that uses a double "X-frame" adjustment mechanism to connect the desktop assembly to the base support. The double "X-frame" configuration of the adjustment mechanism improve frame strength without adversely affecting the foldability of the frame.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A desktop assembly and height adjustment frame mechanism that facilitates height adjustment of said desktop, said desktop assembly and height frame adjustment mechanism comprising:

a. a desktop assembly for placement in a stationary position on top of an existing desk comprising upper and lower platform surfaces each configured to support one or more monitors and a keyboard;

b. a frame adjustment mechanism for adjustably supporting said desktop comprising:

i. an upper support frame, including a left upper bracket and a right upper bracket, wherein each of said left and right upper brackets includes proximal and distal ends and each contain horizontal channels at their distal ends and wherein each of said left and right upper brackets is fixedly attached to the underside of said upper platform surface of said desktop;

ii. a base support frame, including a left lower bracket and a right lower bracket, wherein each of said left and right lower brackets includes proximal and distal ends and each contain horizontal channels at their distal ends and wherein each of said left and right lower brackets is fixedly attached to the topside of said base support frame;

iii. an X-shaped support frame that pivotally connects said upper support frame and said base support frame and permits a user to selectively adjust the height of said upper and lower platform surfaces of said desktop by vertically moving the desktop about a perpendicular axis relative to said base support frame, wherein said X-shaped support frame comprising a pair of left and right first pivot legs pivotally interconnected at the center to a pair of left and right second pivot legs, wherein:

aa. said first pivot legs each having lower and upper ends, wherein said lower ends of said first pivot legs are pivotally connected to said proximal ends of each of said left and right lower brackets, and wherein said upper ends of said first pivot legs are pivotally and slideably attached within said horizontal channels of said distal ends of said left and right upper brackets, and wherein said first pivot legs are further connected to each other by one or more lateral stabilizing bars;

bb. said second pivot legs each having lower and upper ends, wherein said upper ends of said second pivot legs are pivotally connected to said proximal ends of each of said left and right upper brackets, and wherein said lower ends of said second pivot legs are pivotally and slideably attached within said horizontal channels of said left and right lower brackets, and wherein said second pivot legs are further connected to each other by one or more lateral stabilizing bars;

cc. a pair of hydraulic cylinders for facilitating raising and lowering said upper and lower platform surfaces, wherein each hydraulic cylinder has a lower end and an upper end, and wherein said lower end of each hydraulic cylinder is connected to said proximal ends of each of said left and right lower brackets, and wherein said upper end of each hydraulic cylinder is attached to the middle portion of each of said first pivot legs; and dd. a pair of manually adjustable locking levers, each pivotally attached to said upper platform surface and wherein each locking lever includes multiple teeth for selecting and mateably engaging one of said selected teeth with said left and right upper brackets for incrementally locking and unlocking the upper and lower platform surfaces at a selected height.

2. A desktop assembly according to claim 1, wherein the upper and lower platform surfaces comprise a main work platform and a secondary work platform arranged at different heights with respect to each other and the existing work surface.

3. A desktop assembly according to claim 2, wherein the main work platform is configured to support one or more monitors and wherein the secondary work platform is configured to support a keyboard and a computer input device.

4. A desktop assembly according to claim 1, wherein the upper and lower platform surfaces each comprise a single platform configured to support one or more monitors and a keyboard.

5. A desktop assembly according to claim 1, wherein the pair of first pivot legs and the pair of second pivot legs are connected together in a scissored relationship.

6. A desktop assembly according claim 1, wherein the selectively manually adjustable height positions of the upper and lower platform surfaces includes a lowered position to facilitate use of the desktop assembly by a user in a sitting position and a raised position to facilitate use by a user in a standing position.

7. A desktop assembly according claim 1, wherein the lower platform surface is fixedly attached to the upper platform surface by at least one bracket.

8. A desktop assembly according claim 1, wherein the lower platform surface is adjustably attached to the upper platform surface.

* * * * *